US008910616B2

(12) United States Patent
Raasch

(10) Patent No.: US 8,910,616 B2
(45) Date of Patent: Dec. 16, 2014

(54) CARBURETOR SYSTEM FOR OUTDOOR POWER EQUIPMENT

(75) Inventor: Jason J. Raasch, Cedarburg, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 901 days.

(21) Appl. No.: 13/092,027

(22) Filed: Apr. 21, 2011

(65) Prior Publication Data

US 2012/0267137 A1 Oct. 25, 2012

(51) Int. Cl.

| | |
|---|---|
| ***F02M 7/00*** | (2006.01) |
| ***F02M 7/17*** | (2006.01) |
| ***F02M 17/48*** | (2006.01) |
| ***F02M 1/02*** | (2006.01) |
| ***F02M 19/12*** | (2006.01) |
| *F02M 19/08* | (2006.01) |

(52) U.S. Cl.

CPC . *F02M 1/02* (2013.01); *F02M 7/17* (2013.01); *F02M 17/48* (2013.01); *F02M 19/12* (2013.01)

USPC ..... 123/439; 123/704

(58) Field of Classification Search

USPC ..... 123/439, 437, 442, 704; 261/44.7, 44.8, 261/44.9, 42

See application file for complete search history.

(56) References Cited

U.S. PATENT DOCUMENTS

| | | | |
|---|---|---|---|
| 1,128,782 | A | 2/1915 | Hartford |
| 1,265,883 | A | 5/1918 | Church |
| 1,745,492 | A | 2/1930 | Kelch et al. |
| 1,982,945 | A | 12/1934 | Armstrong |
| 2,009,659 | A | 7/1935 | Hill et al. |
| 2,022,094 | A | 11/1935 | Shoemaker et al. |
| 2,134,889 | A | 1/1938 | Phillips |
| 2,138,100 | A | 11/1938 | Howard |
| 2,221,201 | A | 11/1940 | Pope, Jr. et al. |
| 2,241,096 | A | 5/1941 | McCullough |
| 2,338,912 | A | 1/1944 | Ericson |
| 2,367,606 | A | 1/1945 | Olson |
| 2,382,952 | A | 8/1945 | Armstrong |
| 2,397,208 | A | 3/1946 | Saco, Jr. et al. |
| 2,499,263 | A | 2/1950 | Troy |
| 2,529,437 | A | 11/1950 | Weinberger |
| 2,533,180 | A | 12/1950 | Rhodes |
| 2,544,607 | A | 3/1951 | Mallory |

(Continued)

FOREIGN PATENT DOCUMENTS

| | | | | |
|---|---|---|---|---|
| GB | 0 149 14 | | 10/1915 | |
| JP | 55001420 | A * | 1/1980 | ..... F02M 7/00 |

(Continued)

OTHER PUBLICATIONS

Office Action for U.S. Appl. No. 12/725,311, mail date Sep. 24, 2013, 5 pages.

(Continued)

*Primary Examiner* — Mahmoud Gimie

(74) *Attorney, Agent, or Firm* — Foley & Lardner LLP

(57) ABSTRACT

A carburetor includes a passageway having a constricted section, a nozzle directed into the passageway proximate the constricted section, and a shaft having a surface that at least partially defines the constricted section. The nozzle is configured to deliver fuel to air passing through the passageway, and the surface includes a contour that is configured to be moved relative to the passageway to change the area of the passageway through the constricted section.

12 Claims, 8 Drawing Sheets

(56) References Cited

U.S. PATENT DOCUMENTS

| | | | |
|---|---|---|---|
| 2,585,814 | A | 2/1952 | McDonald |
| 2,613,657 | A | 10/1952 | Sloane et al. |
| 2,635,596 | A | 4/1953 | Adler |
| 2,716,397 | A | 8/1955 | Heinish |
| 2,781,751 | A | 2/1957 | Benjamin |
| 2,804,552 | A | 8/1957 | McFarland |
| 2,837,070 | A | 6/1958 | Agar |
| 2,867,196 | A | 1/1959 | Francis |
| 2,947,600 | A | 8/1960 | Clayton |
| 3,139,079 | A | 6/1964 | Bettoni |
| 3,209,532 | A | 10/1965 | Morris et al. |
| 3,217,652 | A | 11/1965 | Olson |
| 3,242,741 | A | 3/1966 | Catterson |
| 3,276,439 | A | 10/1966 | Reichenbach |
| 3,280,903 | A | 10/1966 | Stoddard, Jr. |
| 3,306,035 | A | 2/1967 | Morrell |
| 3,354,873 | A | 11/1967 | Burnell |
| 3,476,094 | A | 11/1969 | Guernsey et al. |
| 3,659,499 | A | 5/1972 | Woodward |
| 3,666,057 | A | 5/1972 | Leifer et al. |
| 3,760,785 | A | 9/1973 | Harrison et al. |
| 3,786,869 | A | 1/1974 | McLoughlin |
| 3,847,131 | A | 11/1974 | Hisatomi |
| 3,881,685 | A | 5/1975 | Hase et al. |
| 3,937,302 | A | 2/1976 | Palmcrantz |
| 3,971,356 | A | 7/1976 | Schlage |
| 3,982,397 | A | 9/1976 | Laurent |
| 3,983,697 | A | 10/1976 | Goto et al. |
| 3,997,019 | A | 12/1976 | Inoue |
| 4,022,179 | A | 5/1977 | Kalert et al. |
| 4,083,338 | A | 4/1978 | Bertling et al. |
| 4,084,373 | A | 4/1978 | Hashimoto et al. |
| 4,094,284 | A | 6/1978 | Gesell |
| 4,103,652 | A | 8/1978 | Garside et al. |
| 4,117,640 | A | 10/1978 | Vanderstar |
| 4,139,332 | A | 2/1979 | Cantrell et al. |
| 4,154,058 | A | 5/1979 | Mase et al. |
| 4,165,611 | A | 8/1979 | Ishikawa |
| 4,176,642 | A | 12/1979 | Shipinski |
| 4,290,399 | A | 9/1981 | Takada et al. |
| 4,304,202 | A | 12/1981 | Schofield |
| 4,342,299 | A | 8/1982 | Haka |
| 4,355,611 | A | 10/1982 | Hasegawa |
| 4,368,704 | A | 1/1983 | Masaki |
| 4,370,960 | A | 2/1983 | Otsuka |
| 4,383,510 | A | 5/1983 | Nakamura et al. |
| 4,387,565 | A | 6/1983 | Otani et al. |
| 4,391,246 | A | 7/1983 | Kawabata et al. |
| 4,395,876 | A | 8/1983 | Marsee et al. |
| 4,425,888 | A | 1/1984 | Engel et al. |
| 4,437,306 | A | 3/1984 | Ikenoya et al. |
| 4,450,932 | A | 5/1984 | Khosropour et al. |
| 4,502,436 | A | 3/1985 | Bonfiglioli et al. |
| 4,510,903 | A | 4/1985 | Sakakiyama |
| 4,526,060 | A | 7/1985 | Watanabe |
| 4,530,334 | A | 7/1985 | Pagdin |
| 4,546,744 | A | 10/1985 | Bonfiglioli |
| 4,549,400 | A | 10/1985 | King |
| 4,559,185 | A | 12/1985 | Seto et al. |
| 4,567,870 | A | 2/1986 | Tumber |
| 4,640,245 | A | 2/1987 | Matsuda et al. |
| 4,660,518 | A | 4/1987 | Tamaki |
| 4,709,675 | A | 12/1987 | Fujita |
| 4,773,369 | A | 9/1988 | Kobayashi et al. |
| 4,793,309 | A | 12/1988 | Huffman et al. |
| 4,836,164 | A | 6/1989 | Morozumi et al. |
| 4,836,167 | A | 6/1989 | Huffman et al. |
| 4,884,541 | A | 12/1989 | Marriott |
| 4,941,443 | A | 7/1990 | Yamaguchi et al. |
| 4,944,267 | A | 7/1990 | Mann |
| 4,969,435 | A | 11/1990 | Morikawa et al. |
| 4,977,879 | A | 12/1990 | Schmidt et al. |
| 5,003,949 | A | 4/1991 | Fanner et al. |
| 5,035,580 | A | 7/1991 | Simonette |
| 5,060,744 | A | 10/1991 | Katoh et al. |
| 5,069,180 | A | 12/1991 | Schmidt et al. |
| 5,146,889 | A | 9/1992 | Swanson et al. |
| 5,186,142 | A | 2/1993 | Brunelli et al. |
| 5,208,519 | A | 5/1993 | Dykstra et al. |
| 5,235,804 | A | 8/1993 | Colket et al. |
| 5,235,943 | A | 8/1993 | Fiorenza, II |
| 5,293,854 | A | 3/1994 | Tracy et al. |
| 5,345,763 | A | 9/1994 | Sato |
| 5,351,529 | A | 10/1994 | Locke, Sr. |
| 5,431,013 | A | 7/1995 | Yamaki et al. |
| 5,459,664 | A | 10/1995 | Buckalew |
| 5,459,998 | A | 10/1995 | Hosoya et al. |
| 5,479,908 | A | 1/1996 | Grinberg et al. |
| 5,503,125 | A | 4/1996 | Gund |
| 5,526,786 | A | 6/1996 | Beck et al. |
| 5,595,531 | A | 1/1997 | Niemela et al. |
| 5,642,711 | A | 7/1997 | Boner et al. |
| D382,853 | S | 8/1997 | Crawford |
| 5,666,804 | A | 9/1997 | Sekiya et al. |
| 5,680,024 | A | 10/1997 | Ehle et al. |
| 5,720,906 | A | 2/1998 | Yamanaka et al. |
| 5,726,503 | A | 3/1998 | Domanski et al. |
| 5,810,560 | A | 9/1998 | Tanaka |
| 5,902,971 | A | 5/1999 | Sato et al. |
| 6,021,370 | A | 2/2000 | Bellinger et al. |
| 6,092,793 | A | 7/2000 | Yanagii |
| 6,113,193 | A | 9/2000 | Kunzeman |
| 6,216,453 | B1 | 4/2001 | Maurer |
| 6,276,449 | B1 | 8/2001 | Newman |
| 6,365,982 | B1 | 4/2002 | Iles et al. |
| 6,435,482 | B1 * | 8/2002 | Omi et al. ..... 261/70 |
| 6,971,369 | B1 | 12/2005 | Mitchell et al. |
| 6,983,736 | B2 | 1/2006 | Mitchell et al. |
| 7,353,802 | B1 | 4/2008 | Iwata et al. |
| 7,373,921 | B2 | 5/2008 | Geyer et al. |
| 7,950,366 | B2 | 5/2011 | Arai et al. |
| 8,567,371 | B2 | 10/2013 | Vaughn et al. |
| 2002/0053339 | A1 | 5/2002 | Bootle et al. |
| 2003/0037749 | A1 | 2/2003 | Imafuku et al. |
| 2004/0112333 | A1 | 6/2004 | Mitchell et al. |
| 2006/0054381 | A1 | 3/2006 | Takemoto et al. |
| 2006/0151891 | A1 * | 7/2006 | Meyer ..... 261/18.2 |
| 2007/0068496 | A1 * | 3/2007 | Wright ..... 123/527 |
| 2007/0079604 | A1 | 4/2007 | Macaluso |
| 2007/0240404 | A1 | 10/2007 | Pekrul et al. |
| 2008/0014096 | A1 | 1/2008 | Gilpatrick |
| 2011/0005024 | A1 | 1/2011 | Spitler et al. |
| 2011/0214641 | A1 | 9/2011 | Vaughn et al. |
| 2011/0226217 | A1 | 9/2011 | Raasch |

FOREIGN PATENT DOCUMENTS

| | | |
|---|---|---|
| JP | 61-207836 | 9/1986 |
| JP | 11-093750 | 4/1999 |
| SU | 853138 | 8/1981 |
| SU | 1740741 | 6/1992 |

OTHER PUBLICATIONS

International Search Report and Written Opinion for International Application No. PCT/US2013/043758, dated Sep. 24, 2013, 16 pages.

International Search Report and Written Opinion for International Application No. PCT/US12/33891, mail date Aug. 9, 2012, 6 pages.

Partial International Search Report regarding International Application No. PCT/US2013/043758, dated Aug. 2, 2013, 2 pages.

Honda Power Equipment; printed from website http://www.hondapowerequipment.com/products/generators/content.aspx on Mar. 15, 2010, 5 pages.

Honda; V-Twin Engines, © 2002, American Honda Motor Co., Inc., 10 pages.

Honda; V-Twin Series Engines, © 2009, American Honda Motor Co., Inc., 11 pages.

Notice of Allowance on U.S. Appl. No. 13/492,680, mail date Sep. 10, 2014, 6 pages.

* cited by examiner

CARBURETOR SYSTEM FOR OUTDOOR POWER EQUIPMENT

BACKGROUND

The present invention relates generally to the field of carburetor systems. More specifically, the present invention relates to carburetor systems for engines configured to run outdoor power equipment, such as snow throwers.

Snow throwers and other types of outdoor power equipment are typically driven by an internal combustion engine. The engine includes a carburetor, which adds fuel to air flowing through the engine for combustion processes occurring within the engine. The carburetor includes a passageway through which air typically flows from an air cleaner or filter to a combustion chamber of the engine.

Along the passageway, the carburetor includes a venturi section having a constricted area, where the cross-sectional area orthogonal to the flow of air through the carburetor is reduced relative to portions of the passageway before and after the constricted area. The carburetor further includes a nozzle in or near the venturi section that is in fluid communication with fuel.

Constriction of the passageway through the venturi section increases the velocity of air passing through the constricted area, which generates low pressure at the nozzle. The low pressure pulls fuel through the nozzle and into the air. The fuel mixed with the air is then burned in the combustion chamber to power the engine, which in turn drives a crankshaft that powers the auger of the snow thrower.

SUMMARY

One embodiment of the invention relates to a carburetor. The carburetor includes a passageway having a constricted section, a nozzle directed into the passageway proximate the constricted section, and a shaft having a surface that at least partially defines the constricted section. The nozzle is configured to deliver fuel to air passing through the passageway, and the surface includes a contour that is configured to be moved relative to the passageway to change the area of the passageway through the constricted section.

Another embodiment of the invention relates to an engine, which includes a fuel tank, a well configured to hold fuel delivered from the fuel tank, an air intake, a combustion chamber, and a passageway configured to channel air from the air intake to the combustion chamber. The passageway includes a surface at least partially defining a constricted section of the passageway, where the surface is configured to be adjusted to change the area of the passageway through the constricted section. The engine further includes a nozzle, a vent configured to connect the well with outside air, and a variable restrictor configured to limit the connection provided by the vent between the well and outside air. The nozzle is in fluid communication with the well and is directed into the passageway proximate to the constricted section, which provides a relative low pressure in air passing through the passageway that draws fuel from the nozzle to the air. The degree of restriction provided by the variable restrictor is a function of the area of the constricted section of the passageway.

Yet another embodiment of the invention relates to outdoor power equipment, which includes a frame, wheels coupled to the frame, a fuel tank, and an engine mounted to the frame. The engine includes an air intake, a combustion chamber, and a passageway configured to channel air from the air intake to the combustion chamber. The passageway has a surface at least partially defining a constricted section of the passageway, where the surface is configured to be adjusted to change the area of the passageway through the constricted section. The engine further includes a well configured to hold fuel delivered from the fuel tank, and a nozzle in fluid communication with the well and directed into the passageway proximate to the constricted section of the passageway. The constricted section of the passageway provides a relative low pressure in air passing through the passageway that draws fuel from the nozzle to the air. The outdoor power equipment further includes a rotating tool driven by the engine, and a control interface configured to allow an operator to adjust the surface at least partially defining the constricted section of the passageway when the engine is in a wide-open throttle configuration, which changes the area of the passageway through the constricted section.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
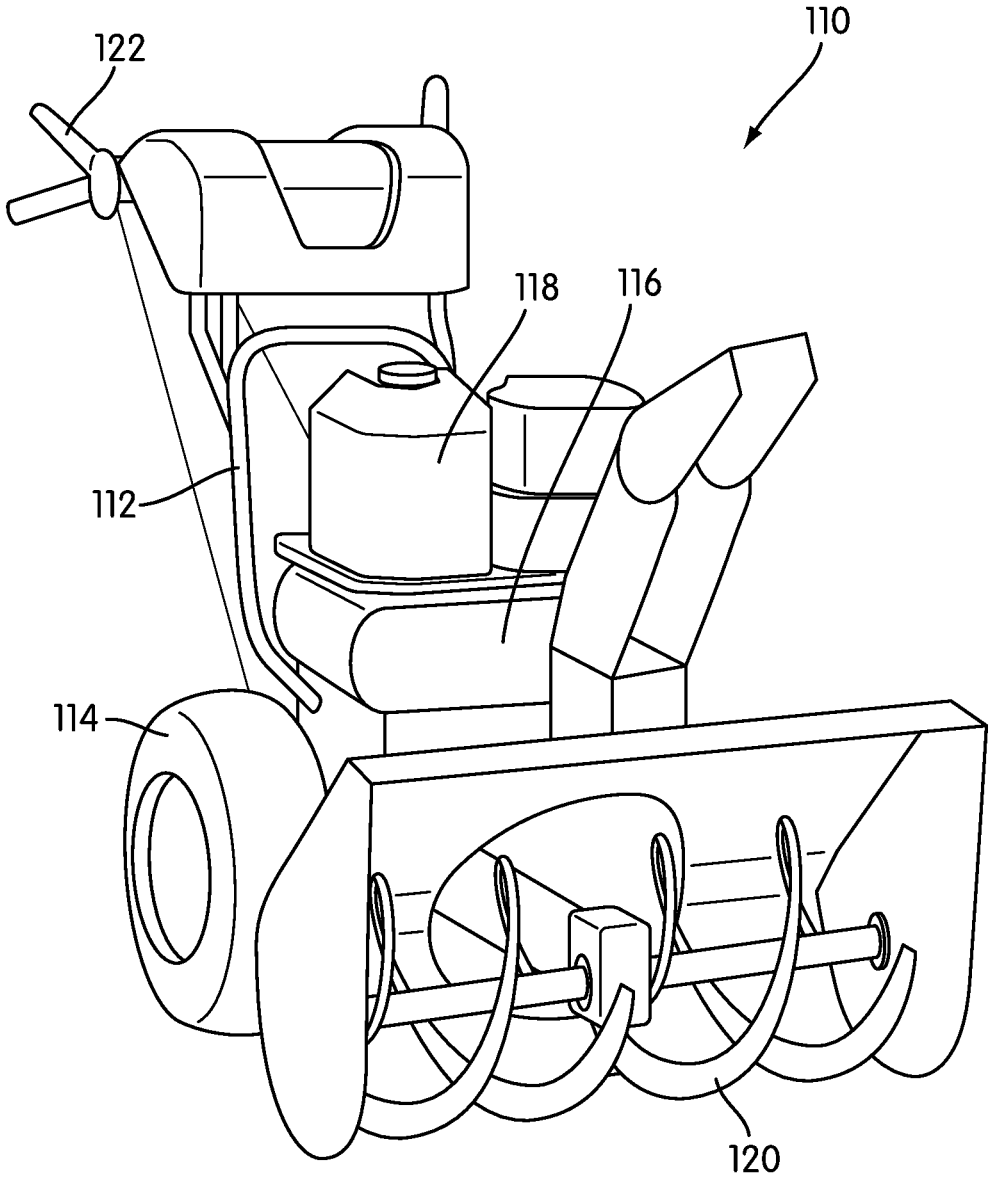
FIG. 1 is a perspective view of a snow thrower according to an exemplary embodiment of the invention.

Referring to FIG. 1, outdoor power equipment in the form of a snow thrower 110 includes a frame 112, wheels 114 coupled to the frame 112, an engine 116, and fuel tank 118. The snow thrower 110 further includes a rotating tool in the form of an auger 120 that is configured to be driven by the engine 116. A control interface in the form of one or more of a throttle lever 122, on/off switch, and drive settings, or other features is coupled to the frame 112. While FIG. 1 shows the snow thrower 110, in other embodiments, outdoor power equipment may be in the form of a broad range of equipment, such as a walk-behind or driving lawnmower, a rotary tiller, a pressure washer, a tractor, or other equipment using an engine.

Figure 2:
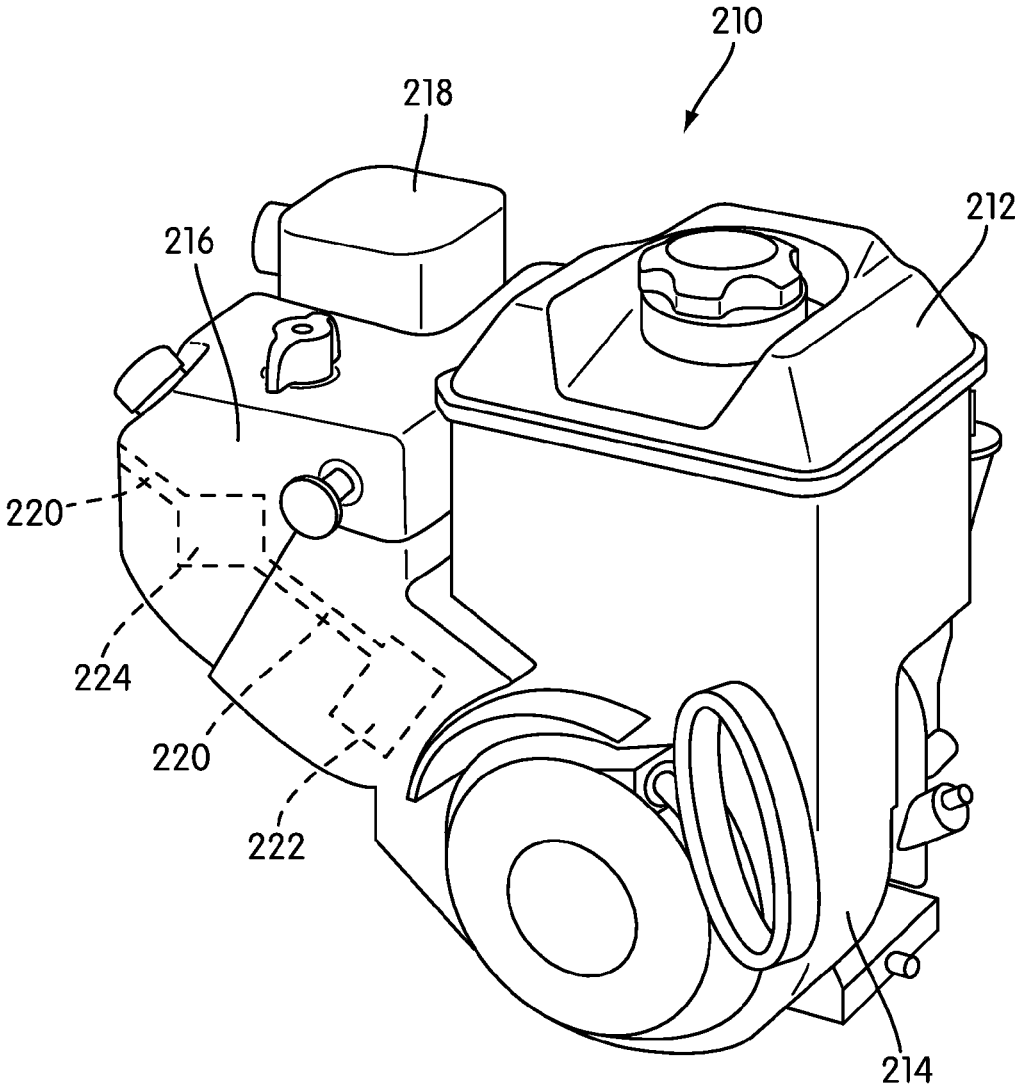
FIG. 2 is a perspective view of an engine according to an exemplary embodiment of the invention.

Referring to FIG. 2, an engine in the form of a small, single-cylinder, four-stroke cycle, internal combustion engine 210 includes a fuel tank 212, an engine block 214, an air intake 216, and an exhaust 218. Interior to the engine 210, the engine 210 includes a passageway 220 configured to channel air from the air intake 216 to a combustion chamber 222. Along the passageway 220, fuel is mixed with the air in a carburetor 224 or other fuel injection device. Combustion in the combustion chamber 222 converts chemical energy to mechanical energy (e.g., rotational motion; torque) via a piston, connecting rod, and crankshaft, which may then be coupled to one or more rotating tools (e.g., blade, alternator, auger, impeller, tines, drivetrain) of outdoor power equipment.

Figure 3:
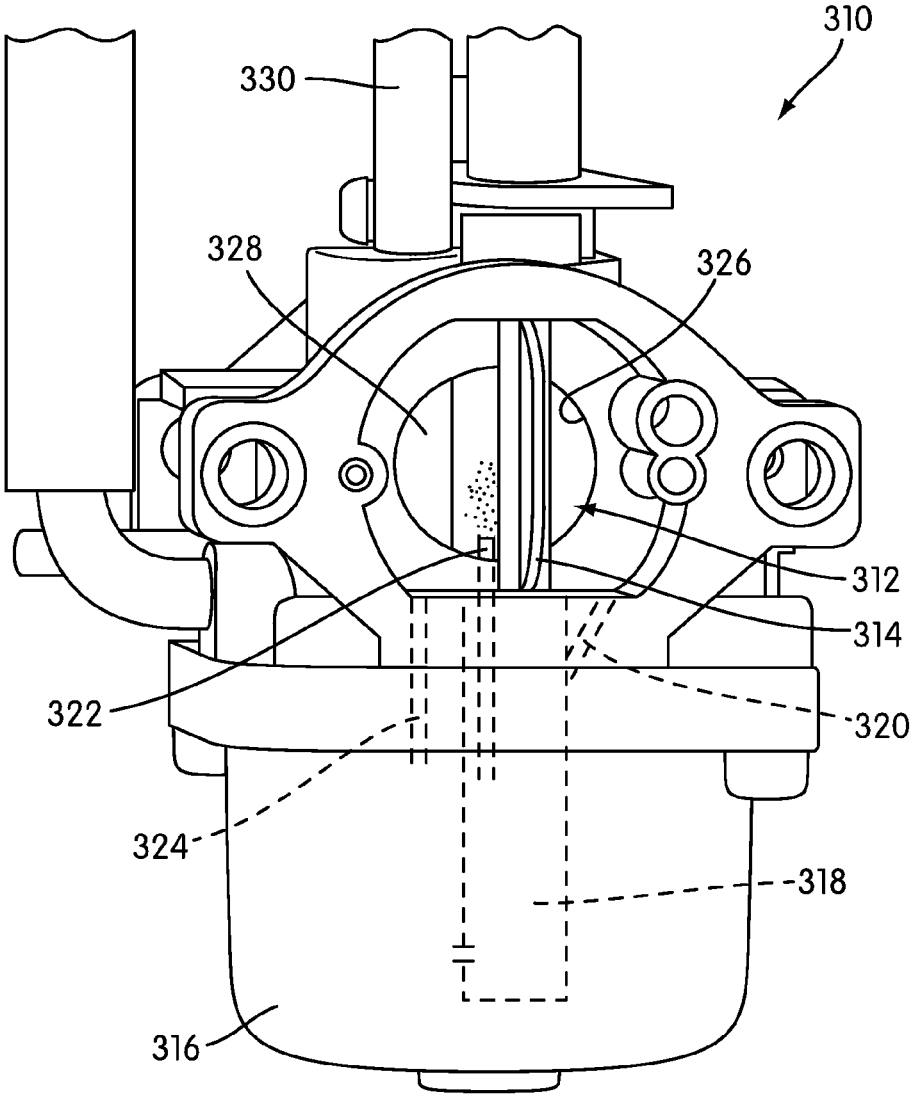
FIG. 3 is a perspective view of a carburetor in a first configuration according to an exemplary embodiment of the invention.
Figure 4:
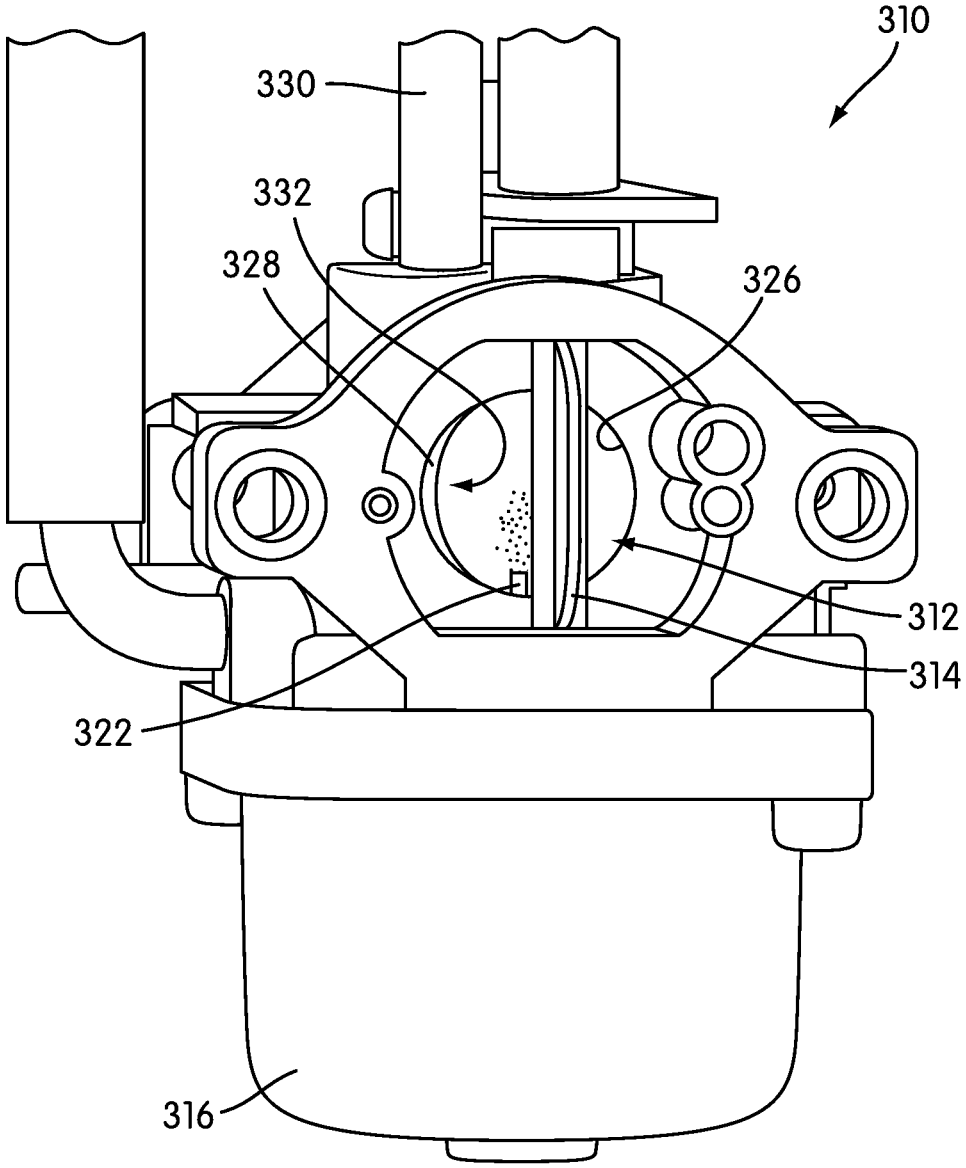
FIG. 4 is a perspective view of the carburetor of FIG. 3 in a second configuration.

Referring now to FIGS. 3-4, a carburetor 310 for an engine (see, e.g., engine 210 as shown in FIG. 2) includes a throat 312 (e.g., conduit, passage, flow path) and, in some embodiments, at least one plate 314 (e.g., throttle plate, choke plate, both throttle and choke plates) configured to function as a butterfly valve to control the flow of air, or a mixture of fuel and air, through the carburetor 310. In FIGS. 3-4, the plate 314 is in an open configuration (e.g., wide-open throttle). According to an exemplary embodiment, the throat 312 of the carburetor 310 is positioned along a passageway extending from an air intake of the engine to a combustion chamber of the engine (see, e.g., passageway 220 as shown in FIG. 2).

The carburetor 310 is coupled to (e.g., in fluid communication with) a fuel tank (see, e.g., fuel tank 118 as shown in FIG. 1) by way of a fuel line or other conduit. The fuel tank may be mounted to the engine, integrated with the engine, or positioned on a frame of outdoor power equipment apart from the engine. In some embodiments the carburetor 310 includes a bowl 316 (e.g., container) that receives fuel from the fuel line. In some such embodiments, a float coupled to a valve is used to regulate the flow of fuel from the fuel line into the bowl 316. From the bowl 316, the fuel is delivered to a well 318 of the carburetor 310 (e.g., emulsion tube well), which is also coupled to a vent 320 and a nozzle 322. In some embodiments, air flows into the well 318 through the vent 320 and mixes with the fuel. Another vent 324 may be coupled to the bowl 316.

According to an exemplary embodiment, the carburetor 310 includes a constricted section 326 (e.g., narrower segment, venturi) integrated with the throat 312 that is bordered by wider portions of the passageway. The nozzle 322 of the carburetor 310 is directed into the passageway proximate to the constricted section 326, such as along the portion of the passageway closely following the most constricted portion of the constricted section 326. As air flows along the passageway through the carburetor 310, the velocity of the air increases through the constricted section 326. The increase in velocity corresponds to a decrease in pressure, which acts upon the nozzle 322, drawing fuel through the nozzle 322 and into the flow of air through the passageway.

According to an exemplary embodiment, the carburetor 310 further includes a surface 328 that at least partially defines the constricted section 326. The surface 328 is configured to be adjusted to change the area of the passageway through the constricted section 326. In some embodiments, the surface 328 is at least a portion of a contour on a shaft 330. As the shaft 330 is moved relative to the passageway, the orientation or position of the contour is changed relative to the passageway, which changes the shape of the surface 328 and the corresponding area of the constricted section 326 of the passageway.

In some embodiments, the surface 328 includes a section of the shaft 330. In such embodiments, the shaft 330 is substantially cylindrical, but includes a recess 332 (e.g., cut, open portion) on a side of the shaft 330 (FIG. 4). The surface 328 of the shaft 330 that at least partially forms the constricted section 326 of the passageway changes as the shaft 330 is moved (e.g., rotated, translated) relative to the passageway. In a first configuration (e.g., normal mode), the recess 332 is not exposed to the passageway (FIG. 3), which corresponds to greater air flow restriction of the constricted section 326. In a second configuration (e.g., power boost, boost mode), the recess 332 is exposed to the passageway (FIG. 4), which corresponds to lesser air flow restriction of the constricted section 326. In contemplated embodiments, the surface that adjusts the area of the constricted section is on the end of a shaft, which is translated relative to the passageway to change the area of the constricted section.

In the second configuration, the carburetor 310 allows for a greater volume of air to flow through the passageway by reducing the restriction provided by the constricted section 326. However, the velocity of air through the constricted section 326 may correspondingly be reduced, decreasing the vacuum experienced at the end of the nozzle 322 that is open to the passageway. In some embodiments, a vent connecting the well 318 to outside air is at least partially restricted when the carburetor 310 is in the second configuration, which is intended to increase the amount of fuel pulled through the nozzle 322, by decreasing the flow of outside air into the well 318 in response to suction from the nozzle 322. Instead, a greater amount of fuel is pulled into the well 318 from the bowl 316 in response to suction from the nozzle 322. In addition, less air is available to mix with the fuel that exits the nozzle 322. In contemplated embodiment, a variable restrictor is integrated with the nozzle, the bowl, the fuel line, or another part of the engine to adjust the flow rate of fuel or air to compensate for changes in air pressure through the constricted section 326 of the passageway.

Figure 5:
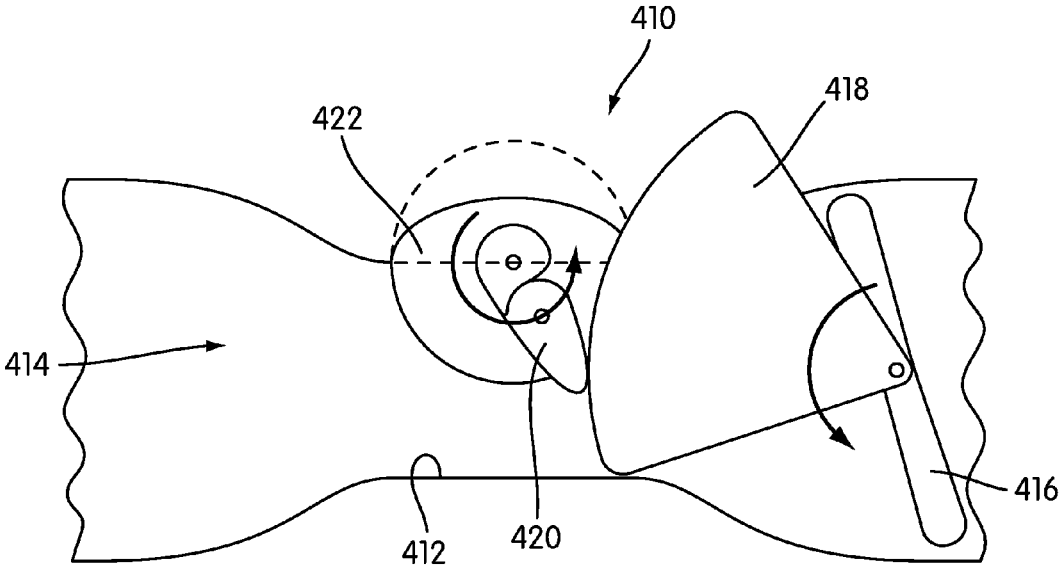
FIG. 5 is a schematic view of a locking system for a carburetor in a first configuration according to an exemplary embodiment of the invention.
Figure 6:
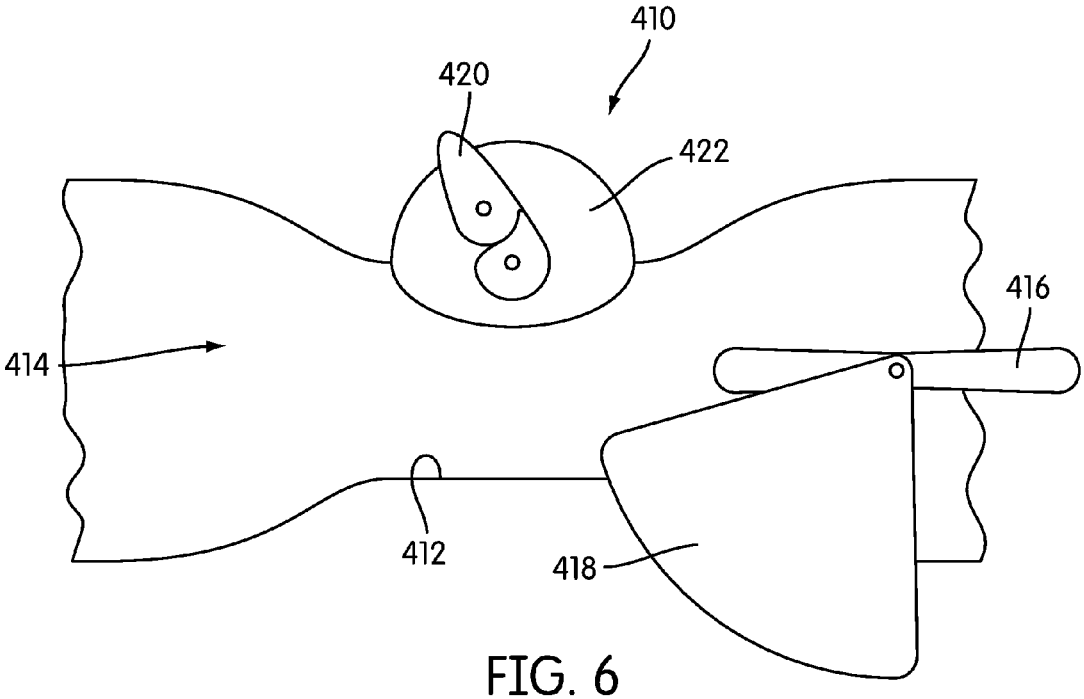
FIG. 6 is a schematic view of the locking system of FIG. 5 in a second configuration.

Referring to FIGS. 5-6, a locking system 410 (e.g., interlock, blocking system) is configured to limit the ability to change the area of a constricted section 412 of a passageway 414 when a throttle plate 416 of the passageway 414 is not in the wide-open throttle position. For example, the area of the constricted section 412 may be locked and thereby not able to be manually adjusted when the throttle plate 416 of the passageway 414 is not in the wide-open throttle position. The locking system 410 may be mechanically, electrically, pneumatically, or otherwise controlled, and may include interfering gears, locking solenoids, releasable hooks, sliding latches, or other components for interlocking parts or limiting movement.

According to an exemplary embodiment, the locking system 410 is mechanically-controlled via interaction of cams. In FIG. 5, a first cam 418 coupled to the throttle plate 416 interferes with a second cam 420 coupled to a vertical shaft 422 extending through a portion of the constricted section 412 of the passageway 414. When the throttle plate 416 is rotated to an open configuration (e.g., wide-open throttle) as shown in FIG. 6, the first cam 418 no longer interferes with the second cam 420. An operator or controller of the shaft 422 is able to rotate the shaft 422 counterclockwise, to change the portion of the shaft 422 that is exposed to the passageway 414, and thereby change the area of the constricted section 412. In some embodiments, the second cam 420 includes two parts that allow for free rotation in one direction, while interlocking to hold the shape of the second cam 420 when rotated in the opposite direction. For example, the two parts of the second cam 420 allow the second cam 420 to freely rotate clockwise to return the second cam 420 to the position of FIG. 5 from the position of FIG. 6, even if the first cam 418 is already in the position of FIG. 5.

Figure 7:
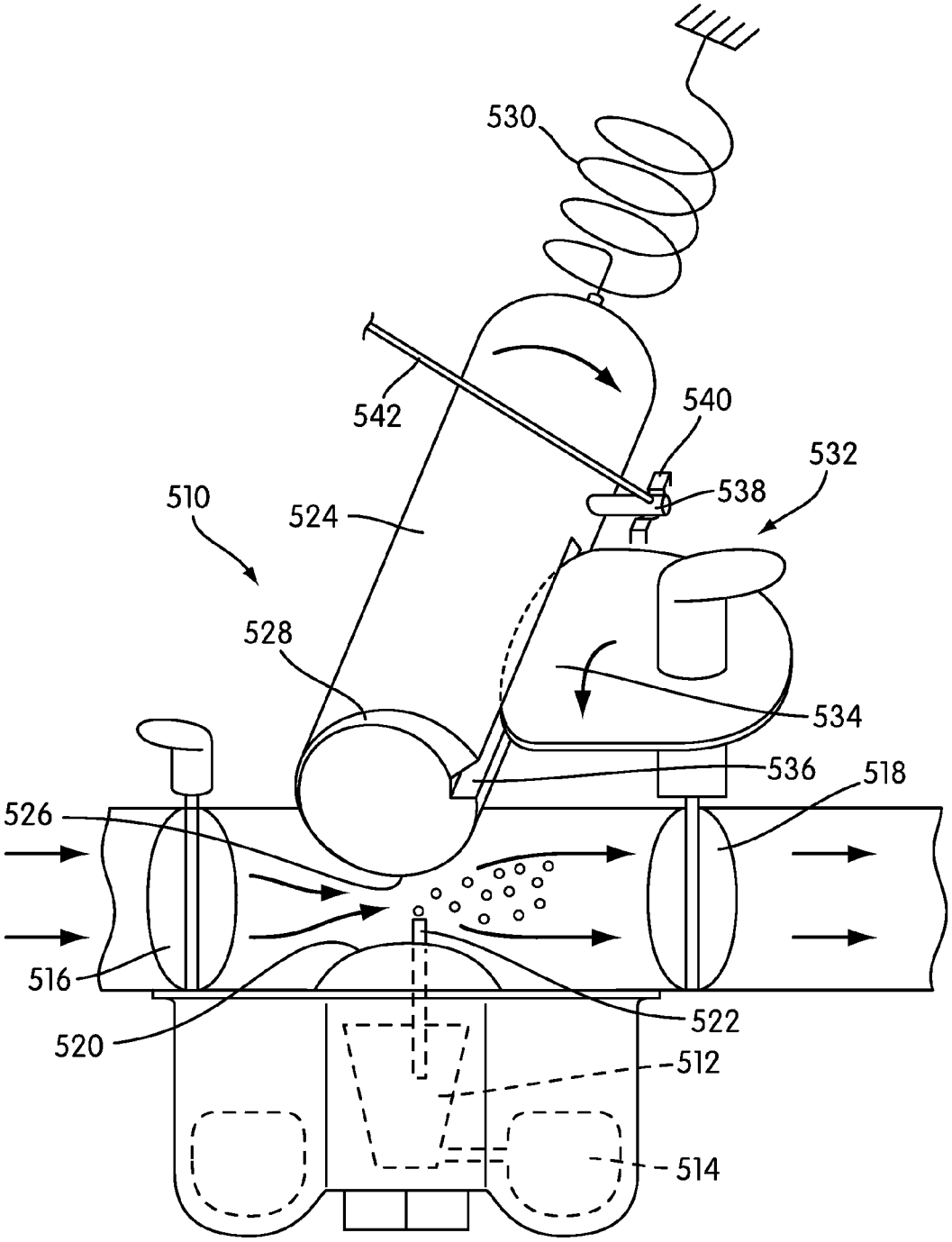
FIG. 7 is a schematic view of a carburetor according to another exemplary embodiment of the invention.

Referring to FIG. 7, a carburetor 510 for an internal combustion engine includes a flow path for air passing between an air intake and a combustion chamber of the engine. The carburetor includes a choke plate 516, a throttle plate 518, and a constricted section 520. A nozzle 522 is open to the flow path proximate to the constricted section 520 and is configured to supply fuel to air passing through the carburetor 510. According to an exemplary embodiment, the fuel is provided to the nozzle 522 from a well 512 in the carburetor 510, which is in communication with a bowl 514 of the carburetor 510.

According to an exemplary embodiment, the carburetor 510 includes a shaft 524 that forms a surface 526 of the constricted section 520 of the flow path. As shown in FIG. 7, the shaft 524 is oriented horizontally with respect to the flow path and includes a contour 528 associated with the constricted section 520. According to an exemplary embodiment, the contour 528 is a segment of a spiral, where the radius of the contour 528 continuously decreases from one angular position to the other about the shaft 524 (i.e., from one end of the contour 528 to the other about the shaft 524). As the shaft 524 is rotated relative to the flow path, the amount of the surface 526 protruding into the constricted section 520 of the flow path decreases, which widens the constricted section 520. Use of a spiral segment or other continuously variable geometry allows for a continuously variable area of the constricted section 520, which may facilitate optimization of the flow path for a given load on the engine, reducing carbon emissions, improving engine performance (e.g., create more power, improved start-ability, and improved "load pickup" or response to changes in load), and increasing fuel efficiency.

According to an exemplary embodiment, the shaft 524 is biased to a first orientation, which corresponds to a narrower area of the constricted section 520. In some embodiments, the shaft is biased by a torsion spring 530 coupled to the shaft 524. In other embodiments, a coil spring or other elastic member is coupled to a side or end of the shaft 524 to bias the shaft 524 in the first orientation. In still other embodiments, the end of the shaft 524 includes a moment arm with a biasing spring or other elastic member, or weight. Bushing, bearings, end pins, and other constraints may be used to limit or facilitate rotation of the shaft.

In some embodiments, the carburetor includes a locking system 532. According to an exemplary embodiment, the locking system 532 includes a cam 534 and a slot 536. The cam 534 is coupled to the throttle plate 518 and the slot 536 (e.g., ledge, lip, flange) is integrated with the shaft 524. If the throttle plate 518 is at least partially closed, the cam 534 is positioned in the slot 536, interlocking the cam 534 and slot 536 to limit the ability to rotate the shaft 524. If the throttle plate 518 is moved to the wide-open throttle position, then the cam 534 is positioned outside of the slot 536, and the shaft 524 is free to rotate. A peg 538 or other surface in a seat 540 or other constraint may prevent the shaft 524 from rotating beyond set limits. An operator or controller can rotate the shaft 524 counterclockwise via a linkage 542.

In contemplated embodiments, a carburetor includes a plate having a curved surface that translates relative to the constricted section of the carburetor, or a disk having a variable shape on the periphery of the disk. As different portions of the surface interface with the flow path through the carburetor, the area of the constricted section changes. In still other contemplated embodiments, a belt is used to expand or contract a flexible or moveable surface that forms the constricted section of the carburetor. The area of the constricted section is inversely related to tension in the belt. In other contemplated embodiments, two or more shafts are used in combination to change the area of a constricted section of the flow path. The shafts may be mechanically coupled to one another.

Figure 8:
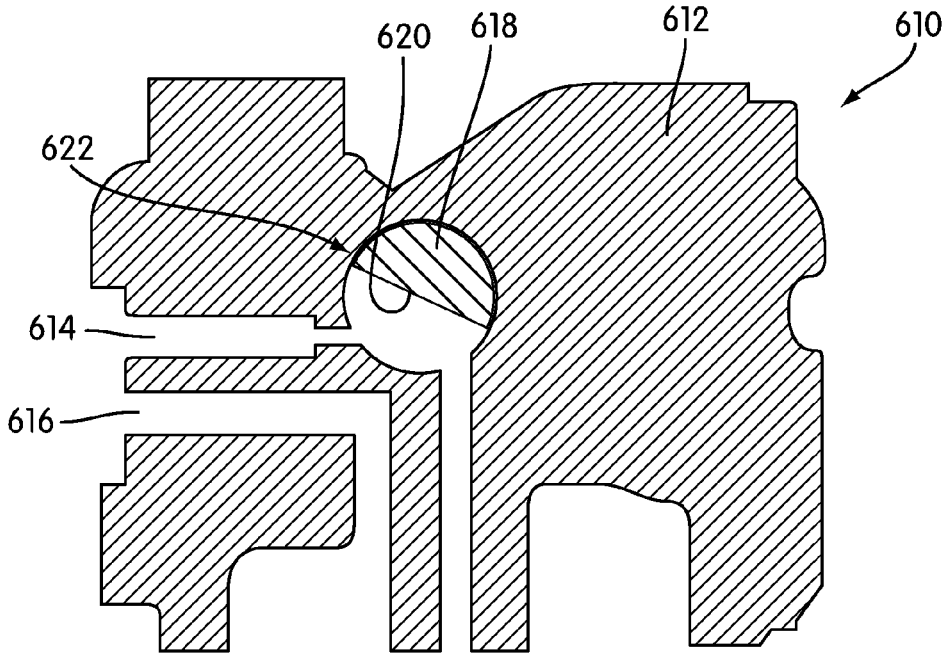
FIG. 8 is a sectional view of vent passages of a carburetor in a first configuration according to an exemplary embodiment of the invention.
Figure 9:
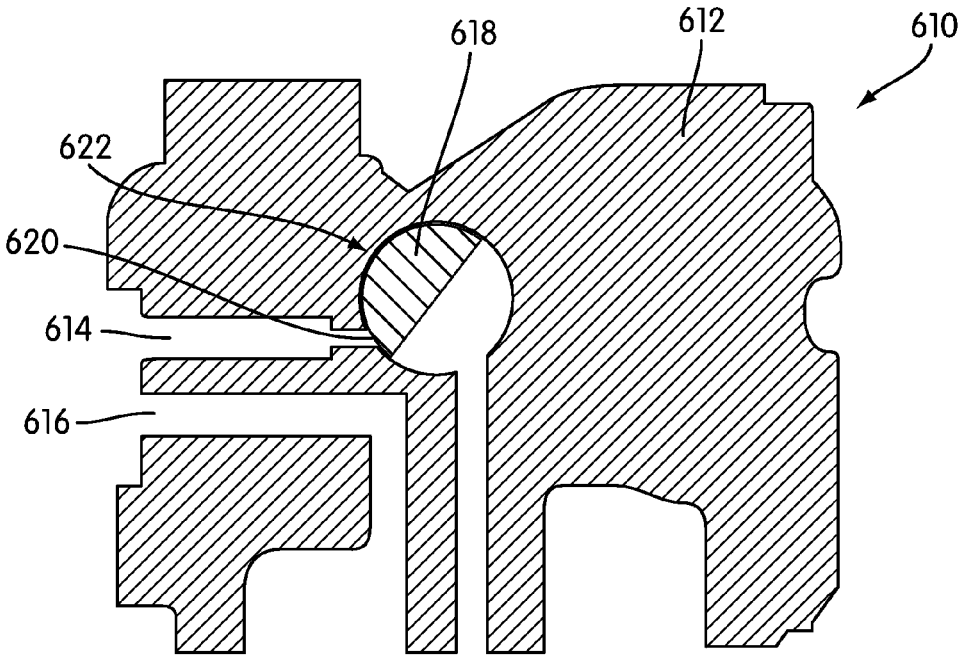
FIG. 9 is a sectional view of the vent passages of FIG. 8 in a second configuration.

Referring now to FIGS. 8-9, a structure of an engine, such as a wall 612 of a carburetor 610, includes a first vent 614 (e.g., conduit, passageway, flow path, channel) and a second vent 616. According to an exemplary embodiment, the first vent 614 connects a well of the carburetor (see, e.g., well 512 as shown in FIG. 7) to outside air (e.g., air at atmospheric pressure, air flowing through the engine prior to passage through the constricted section of the carburetor), and the second vent 616 connects the bowl (see, e.g., bowl 514 as shown in FIG. 7) of the carburetor 610 to outside air. Air from the first vent 614 is added to fuel in the well, and the combined mixture is delivered to air passing through the carburetor 610 by a nozzle (see, e.g., nozzle 522 as shown in FIG. 7).

According to an exemplary embodiment, low pressure from a constricted section integrated with a main flow path (see, e.g., constricted section 520 as shown in FIG. 7) through the carburetor 610 provides suction to draw fuel (and air) through the nozzle. As the fuel is removed from the well via the nozzle, additional fuel is delivered to the well from the bowl and additional air is delivered to the well from the first vent 614. The ratio of additional fuel to additional air delivered to the well is a function of the amount of resistance to flow (e.g., drag, friction, change in moment) provided between the bowl and the well, the amount of resistance through the first vent to the well, the relative viscosities of fuel and air, as well as other factors. All other things being equal, as the resistance through the first vent 614 is increased, a greater amount of fuel will be delivered from the bowl to the well in response to vacuum pressure from the nozzle, and vice versa.

According to an exemplary embodiment, the carburetor 610 includes an adjustable surface (see, e.g., surface 526 as shown in FIG. 7) of the constricted section. In some embodiments, the surface may be manually adjusted, such as by way of a linkage to a control lever or button. In other embodiments, the surface is automatically controlled, such as by a feedback system that is responsive to loading on the engine. In either case, adjustment of the surface changes the area of the constricted section open to air passing through the constricted section. As the constricted section is widened, the velocity of the air passing through the constricted section generally decreases and the suction acting upon the nozzle decreases.

In some embodiments, to increase the amount of fuel provided to air passing through the constricted section as the area of the constricted section widens, restriction in the first vent 614 is increased, decreasing the amount of outside air flowing to the well while increasing the amount of fuel from the bowl flowing to the well. In other contemplated embodiments, restriction between the bowl and the well is decreased in response to an increase in the area through the constricted section. In still other contemplated embodiments, air pressure is increased in the bowl to push more fuel in the bowl into the well in response to an increase in the area through the constricted section. In other embodiments, components that control the amount of fuel injected into the air flowing through the constricted section are otherwise adjusted in response a change in area through the constricted section.

Still referring to FIGS. 8-9, a shaft (see, e.g., shaft 524 as shown in FIG. 7) that provides a adjustable surface of the constricted section of the carburetor 610 is also associated with the first vent 614. In some such embodiments, a portion 618 of the shaft includes a surface 620 of a variable restrictor 622 coupled to the first vent 614. Rotation or translation of the shaft to change the area of the constricted section of the carburetor 610 simultaneously causes the shaft to change the degree of restriction provided by the variable restrictor 622 of the first vent 614. In some embodiments, as the area of the constricted section increases, the amount of restriction in the first vent 614 also increases, and vice versa. In other contemplated embodiments, a restrictor for the first vent not a portion of the shaft, but is mechanically coupled to the shaft, such as by gearing or cams.

Figure 10:
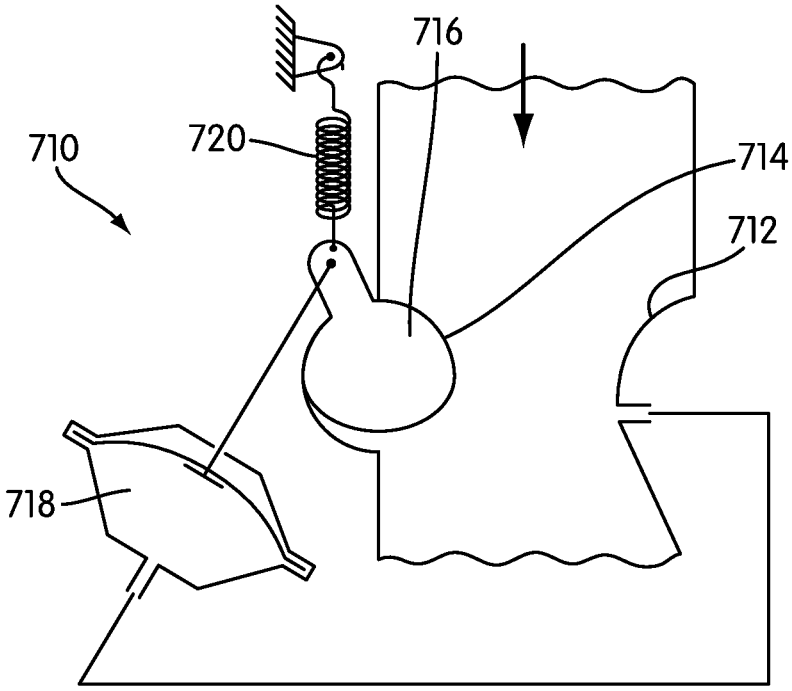
FIG. 10 is a schematic view of a control system for a carburetor in a first configuration according to an exemplary embodiment of the invention.
Figure 11:
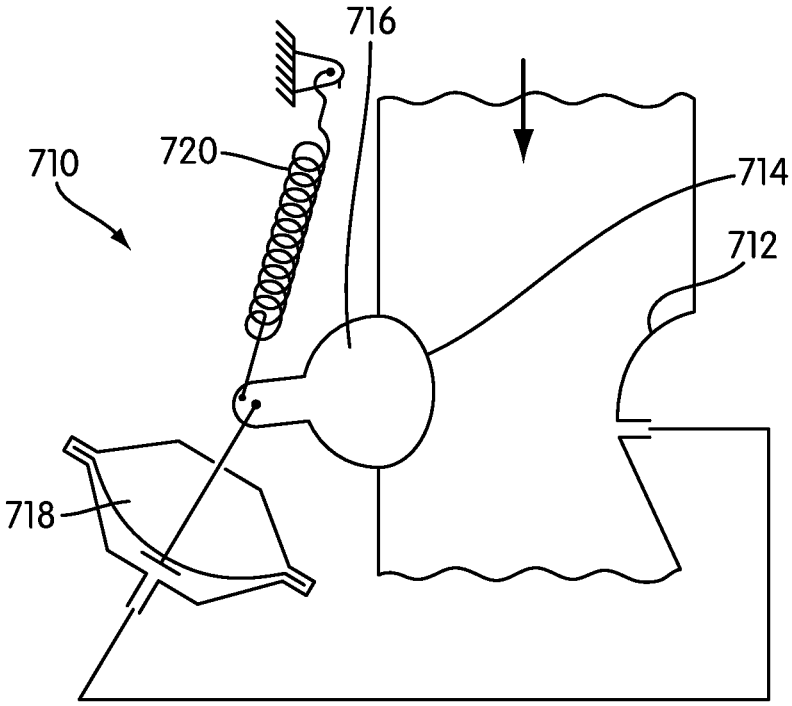
FIG. 11 is a schematic view of the control system of FIG. 10 in a second configuration.

Referring now to FIGS. 10-11, a carburetor system 710 for an engine includes a constricted section 712. The constricted section 712 is at least partially formed from a surface 714 that is adjustable. According to an exemplary embodiment, the surface 714 is formed from a contour (e.g., non-circular portion) of a shaft 716. As the shaft 716 moved relative to a flow path through the constricted section 712, the surface 714 protrudes into the constricted section 712 by a different amount, changing the area through the constricted section 712.

According to an exemplary embodiment, the carburetor system 710 further includes an actuator 718 coupled to the shaft 716, which is configured to move the shaft 716 as a function of loading on the engine. In some embodiments, the actuator 718 is pressure-sensitive (e.g., piston and rod; diaphragm) and is coupled to the engine such that the actuator 718, which is in communication with vacuum pressure of the engine. Vacuum pressure of the engine is related to loading of the engine. In some embodiments, the actuator 718 is coupled to the flow path through the carburetor system 710, following the constricted section 712. In other embodiments, the actuator 718 is coupled to the crankcase.

During operation, a spring 720 may bias the shaft 716 so that the surface 714 forming a portion of the constricted section 712 is in a first configuration, which corresponds to a narrower opening through the constricted section 712. If loading on the engine increases and vacuum pressure of the engine increases (i.e., venturi pressure decreases and vacuum increase), then the actuator 718 will overcome the spring 720, moving the shaft 716 to a second configuration, which corresponds to a wider constricted section 712. The wider constricted section 712 allows for more air to flow through the carburetor system 710 to increase the combustion processes and provide a greater output for the engine. When the loading is reduced and upon engine startup, the spring 720 will bias the shaft 716 into the first configuration.

In some embodiments, a locking system is used with the carburetor system 710 to prevent the shaft 716 from rotating when a throttle plate (see, e.g., throttle plate 518 as shown in FIG. 7) of the carburetor system 710 is not in a wide-open throttle configuration. In some embodiments, the carburetor system 710 may allow for a manual override of the actuator 718, such as by a power-boost button linked to the shaft 716. In some embodiments, the shaft 716 or the actuator 718 may be coupled to a variable restrictor associated with vents to a well or bowl of the carburetor system 710 (see, e.g., first and second vents 614, 616 as shown in FIGS. 8-9). In some embodiments, the surface 714 of the shaft 716 may be shaped as a segment of a spiral such that the area of the constricted section 712 is continuously variable. In contemplated embodiments, a bar, plate, or other structure may include a contoured surface that translates relative to the flow path through the carburetor system 710, to change the area of the constricted section 712.

The construction and arrangements of the carburetor system, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. An engine, comprising:

a fuel tank;

a well configured to hold fuel delivered from the fuel tank;

an air intake;

a combustion chamber;

a passageway configured to channel air from the air intake to the combustion chamber, wherein the passageway comprises a surface at least partially defining a constricted section of the passageway, and wherein the surface is configured to be adjusted to change the area of the passageway through the constricted section;

a nozzle in fluid communication with the well and directed into the passageway proximate to the constricted section, whereby the constricted section of the passageway provides a relative low pressure in air passing through the passageway that draws fuel from the nozzle to the air;

a vent configured to connect the well with outside air; and a variable restrictor configured to limit the connection provided by the vent between the well and outside air, wherein the degree of restriction provided by the variable restrictor is a function of the area of the constricted section of the passageway.

2. The engine of claim 1, wherein the variable restrictor is configured to increasingly restrict the vent as the area of the constricted section of the passageway increases.

3. The engine of claim 2, wherein the variable restrictor is mechanically coupled to the surface at least partially defining the constricted section of the passageway.

4. The engine of claim 2, further comprising a shaft, wherein the surface comprises a contour on the shaft, and wherein the surface is adjusted by moving the contour relative to the passageway.

5. The engine of claim 4, wherein the variable restrictor comprises a second portion of the shaft, whereby rotation of the shaft simultaneously adjusts the area of the constricted section and the degree of restriction provided by the variable restrictor.

6. The engine of claim 1, further comprising a manual control for adjusting the surface to change the area of the constricted section from outside of the engine.

7. The engine of claim 1, further comprising a controller configured to operate the surface as a function of engine load.

8. The engine of claim 7, wherein the controller comprises an actuator that is pressure-sensitive and configured to be responsive to changes in vacuum pressure of the engine.

9. The engine of claim 8, wherein the actuator is coupled to the passageway further from the air intake than the constricted section is from the air intake.

10. Outdoor power equipment, comprising:

a frame;

wheels coupled to the frame;

a fuel tank;

an engine mounted to the frame, comprising:

an air intake;

a combustion chamber;

a passageway configured to channel air from the air intake to the combustion chamber, wherein the passageway comprises a surface at least partially defining a constricted section of the passageway, and wherein the surface is configured to be adjusted to change the area of the passageway through the constricted section;

a well configured to hold fuel delivered to the well from the fuel tank;

a nozzle in fluid communication with the well and directed into the passageway proximate to the constricted section of the passageway, whereby the constricted section of the passageway provides a relative low pressure in air passing through the passageway that draws fuel from the nozzle to the air;

a rotating tool driven by the engine;

a control interface configured to allow an operator to adjust the surface at least partially defining the constricted section of the passageway when the engine is in a wide-open throttle configuration, thereby changing the area of the passageway through the constricted section.

11. The outdoor power equipment of claim 10, wherein the engine further comprises:

a shaft, wherein the surface at least partially defining the constricted section of the passageway comprises a contour on the shaft; and a throttle plate located along the passageway and having a cam coupled thereto, wherein the cam interferes with the shaft, preventing rotation of the shaft when the throttle plate is oriented to partially close the passageway.

12. Outdoor power equipment, comprising:

a frame;

wheels coupled to the frame;

a fuel tank;

an engine mounted to the frame, comprising:

an air intake;

a combustion chamber;

a passageway configured to channel air from the air intake to the combustion chamber, wherein the passageway comprises a surface at least partially defining a constricted section of the passageway, and wherein the surface is configured to be adjusted to change the area of the passageway through the constricted section;

a well configured to hold fuel delivered to the well from the fuel tank;

a nozzle in fluid communication with the well and directed into the passageway proximate to the constricted section of the passageway, whereby the constricted section of the passageway provides a relative low pressure in air passing through the passageway that draws fuel from the nozzle to the air;

a rotating tool driven by the engine;

a control interface configured to allow an operator to adjust the surface at least partially defining the constricted section of the passageway when the engine is in a wide-open throttle configuration, thereby changing the area of the passageway through the constricted section; and a locking system, wherein when the engine is not in the wide-open throttle configuration the control interface is locked by the locking system, preventing the operator from being able to adjust the surface.

* * * * *